US007036156B2

(12) United States Patent
Lahman et al.

(10) Patent No.: US 7,036,156 B2
(45) Date of Patent: May 2, 2006

(54) HEAD PROTECTION SYSTEM

(75) Inventors: Jerome E. Lahman, Tolland, CT (US); Daniel L. Barry, Vernon, CT (US)

(73) Assignee: Jerdan Products, LLC, Vernon, CT (US)

( * ) Notice: Subject to any disclaimer, the term of this patent is extended or adjusted under 35 U.S.C. 154(b) by 310 days.

(21) Appl. No.: 10/438,700

(22) Filed: May 15, 2003

(65) Prior Publication Data

US 2004/0226078 A1 Nov. 18, 2004

(51) Int. Cl.
*A42B 1/22* (2006.01)

(52) U.S. Cl. ..... 2/181; 2/183; 2/195.2; 2/209.3; 2/DIG. 11

(58) Field of Classification Search ..... 2/171, 2/183, 171.1, 181, 209.13, 181.4, 209.3, 2/195.1, 195.4, DIG. 11, 195.2, 411
See application file for complete search history.

(56) References Cited

U.S. PATENT DOCUMENTS

| | | | | | |
|---|---|---|---|---|---|
| 213,415 | A | * | 3/1879 | Halvorson | 2/171.03 |
| 1,513,682 | A | * | 10/1924 | Weinstein et al. | 2/195.2 |
| 1,764,505 | A | * | 6/1930 | Carlson | 2/195.2 |
| 4,481,681 | A | * | 11/1984 | Hankin | 2/183 |
| 4,745,637 | A | | 5/1988 | Steele et al. | 2/411 |
| 4,845,782 | A | * | 7/1989 | Gregg | 2/172 |
| 4,980,937 | A | | 1/1991 | Mason et al. | 5/431 |
| 4,991,236 | A | * | 2/1991 | Pritchett | 2/195.8 |
| 5,075,903 | A | * | 12/1991 | Richoux | 2/411 |
| D343,927 | S | | 2/1994 | Hamdan | D29/12 |
| 5,325,540 | A | * | 7/1994 | Kronenberger | 2/209.3 |
| 5,450,629 | A | * | 9/1995 | Gilstrap | 2/209.11 |
| 5,657,492 | A | * | 8/1997 | Esposito, Jr. | 2/410 |
| 5,675,841 | A | * | 10/1997 | Jackson | 2/175.7 |
| 5,768,715 | A | | 6/1998 | Gregg, III et al. | 2/411 |
| 6,088,838 | A | | 7/2000 | Sontag | 2/202 |
| 6,108,825 | A | | 8/2000 | Bell et al. | 2/455 |
| 6,345,395 | B1 | * | 2/2002 | Chilton | 2/183 |
| 6,493,881 | B1 | | 12/2002 | Picotte | 2/413 |
| 2002/0189004 | A1 | * | 12/2002 | Aaron | 2/411 |

FOREIGN PATENT DOCUMENTS

| | | | |
|---|---|---|---|
| EP | 286726 | A1 * | 10/1988 |
| GB | 2134370 | A * | 8/1984 |

* cited by examiner

*Primary Examiner*—Rodney M. Lindsey
(74) *Attorney, Agent, or Firm*—Perman & Green, LLP

(57) ABSTRACT

A head protection system includes an open-ended tubular cap band of flexible material for partially encircling the head of a wearer generally at the level of the wearer's forehead. A belt member is slidably received through the tubular cap band and adjusts to accommodate the size of the head of the wearer. A crown member of a partial hemispherical shape has an equator region attached to the tubular cap band. In one embodiment, the opposed ends of the belt member include mutually engageable closure devices for joinder to accommodate the wearer's head. In another instance, the belt member is continuous and composed of flexibly expansible material. In still another instance, an elongated air bladder of resilient rubber-like material is received through the cap band with an air pump connected to the interior of the air bladder to selectively fill the air bladder with air.

12 Claims, 10 Drawing Sheets

HEAD PROTECTION SYSTEM

BACKGROUND OF THE INVENTION

1. Field of the Invention

The present invention relates to a system for the protection of the human head from soft tissue damage resulting from impulsive loading as a result of impacts from blunt objects.

2. Description of the Prior Art

The reduction of injury resulting from the effect of head and body impacts has been the subject of research for many years, particularly in the fields of automotive and military research. One commonplace strategy to mitigate the effect of impact on the body is to interpose a layer of protective material between the body and the source of impact. This is especially so in relation to head injuries, with head protection provided in the form of a helmet.

Infants and small children are especially susceptible to banging their heads on hard surfaces due to falls or slips. The typical infant or small child will sustain multiple falls on hard surfaces before it can learn to sit, crawl or walk. For example, infants often crawl beneath chairs and tables. While underneath these items, the child will bang her head when attempting to stand up or lift her head. While the resulting injuries are not life threatening, they cause swelling and bruising about the head. Moreover, the bang or bump to the head is quite traumatic, causing the child to cry or become agitated.

Small children capable of walking or running are particularly vulnerable to falls against table corners, walls and other hard, pointed surfaces. In some instances, serious head injuries can result when a child bangs his or her head against any of these items.

Much of the protective headgear currently available for infants and children is neither fashionable, comfortable nor effective. Many are usually bulky and restrictive. Also, most of a the current protective headgear for small children and infants is not enjoyable to wear, nor is it designed for use in the house during daily activities such as playing, crawling, and learning to walk. Much of the protective headgear for children is designed for outdoor athletic activities, such as soccer, baseball and other contact sports, and is not suitable for everyday wear.

The present invention overcomes the problems of currently available protective headgear by providing a head protector that is attractive, comfortable and effectively provides the infant or child head protection for extended periods of time in a fun, enjoyable manner. The present invention is also low cost and may be worn daily by the infant or child.

A number of examples of known techniques for protection of the human head as described in the patent literature will now be mentioned. In U.S. Pat. No. 6,108,825 to Bell et al., for example, A protective material and a method for the protection of the human head from soft tissue damage caused by an impacting object is provided by a composition having at least two layers of viscoelastic polymeric material. A first layer of the material is substantially matched in acoustic impedance to the impacting object and a second layer of material is selected to produce a large mismatch in acoustic impedance between the first layer and the human head.

Another disclosure is provided by U.S. Pat. No. 6,493,881 to Picotte which is directed to a child's or infant's hat for protection of at least the sides, top or rear of the wearer's head from injuries due to falls or bumps against hard objects. The Picotte head protector includes a cap member with one or more flexible, resilient shock absorbent fluid-containing pads and an outer covering of pliable fabric material.

In U.S. Pat. No. 6,088,838 to Sontag, an adjustable hood is provided which includes a hood portion having a face opening and a rear portion disposed substantially opposite to the face opening, the face opening including a first edge portion and a second edge portion, the first edge portion having first and second spaced apart ends. The adjustable hood also includes a neck portion which is receivable in the hood portion and a cord disposed at the first edge portion of the face opening, the cord being extendable (i) away from the first edge portion of the respective first and second ends, and (ii) towards the rear portion of the hood. A plurality of clamp elements are operable to move along the cord and fixedly engage the cord such that the cord draws the first edge portion of the face opening towards the face of the user when it is extended from and engaged by a pair of the clamp elements at the first and second ends.

In U.S. Pat. No. 5,768,715 to Gregg, III et al., a head protector includes two bands of material, one of which extends from beneath the chin to the top of the head, and the other of which extends from the forehead to the rear of the head. These bands are interconnected together to form a unitary device although, if desired, each band may be used individually. Each band includes padded portions which are preferably filled with a silastic gelin material which is located in areas designed to protect the eye sockets and eyes, zygoma, temporal bones and occiput which are the major bone complexes making up the lower sides and lower back of the skull.

U.S. Pat. No. 4,980,937 to Mason et al. discloses a sitting support and head protection ring for protecting the head of an infant trying to sit up but not yet strong enough. Included are a primary ring configured to conform to the shape of the buttocks, legs and feet of a sitting infant so that the infant is held snugly, the ring being made of a soft yet supportive material. The ring also includes back and head support members provided integrally to the ring for supporting a sitting infant. The protection ring is configured so that when an infant falls, its head falls upon the soft ring.

U.S. Pat. No. 4,745,637 to Steele et al. discloses a head protector for children and invalids which includes a series of concentric rings of tubular fabric packed with yieldable material and a top member of yieldable material. Straps bind the rings and top together, a ring of spaced cushions, or pillows, being positioned between the lowermost ring and the adjacent ring, and a device for positioning the protector on a user's head and preventing rearward movement.

It was with knowledge of the foregoing state of the technology that the present invention has been conceived and is now reduced to practice.

SUMMARY OF THE INVENTION

The present invention relates to a head protection system which includes an open-ended tubular cap band of flexible material for partially encircling the head of a wearer generally at the level of the wearer's forehead. A belt member is slidably received through the tubular cap band and adjusts to accommodate the size of the head of the wearer. A crown member of a partial hemispherical shape has an equator region attached to the tubular cap band. In one embodiment, the opposed ends of the belt member include mutually engageable closure devices for joinder to accommodate the wearer's head. In another instance, the belt member is continuous and composed of flexibly expansible material. In still another instance, an elongated air bladder of resilient rubber-like material is received through the cap band with an air pump connected to the interior of the air bladder to selectively fill the air bladder with air.

A primary feature, then, of the present invention is the provision of a system for the protection of the human head from soft tissue damage resulting from impulsive loading as a result of impacts from blunt objects.

Another feature of the present invention is the provision of such a system which is especially applicable to toddlers ages about six months through three years.

Still another feature of the present invention is the provision of such a system in which an open-ended tubular cap band of flexible material partially encircles the head of a wearer generally at the level of the forehead of the wearer, a belt member is slidably received through the tubular cap band and extends beyond the open ends of the tubular cap band and is adjustable to accommodate the size of the head of the wearer, with a crown member of a partial hemispherical shape having an equator region which is attached to the tubular cap band.

Yet another feature of the present invention is the provision of such a system in which adjustable mutually engageable closure devices are provided on the opposed ends of the belt member for joinder to accommodate the size of the head of the wearer of the head protection system.

Still a further feature of the present invention is the provision of such a system in which the belt member is continuous and composed of flexibly expansible material.

Yet a further feature of the present invention is the provision of such a system in which a tubular cushion band of resilient material composed of foam or gel is received through the tubular cap band, extending beyond the open ends of the tubular cap band and, in turn, slidably receiving the belt member.

Still another feature of the present invention is the provision of such a system in which an open-ended tubular cap band of flexible material is provided for partially encircling the head of a wearer generally at the level of the forehead of the wearer, an elongated air bladder of resilient rubber-like material is slidably received through the tubular cap band extending beyond the open ends of the tubular cap band and is adjustable to accommodate the size of the head of the wearer, an air pump is connected to the interior of the air bladder to selectively fill the air bladder with air, and a crown member of a partial hemispherical shape having an equator region which is attached to the tubular cap band.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
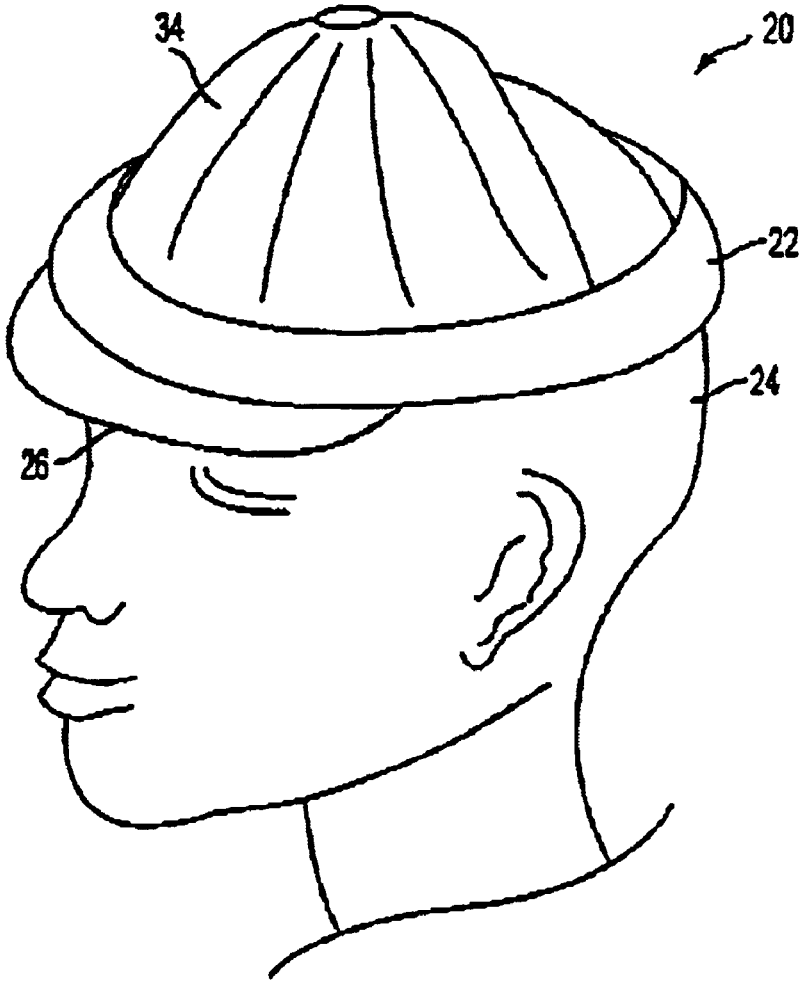
FIG. 1 is a perspective view illustrating a head protection system according to the invention and placed on the head of a wearer.
Figure 2:
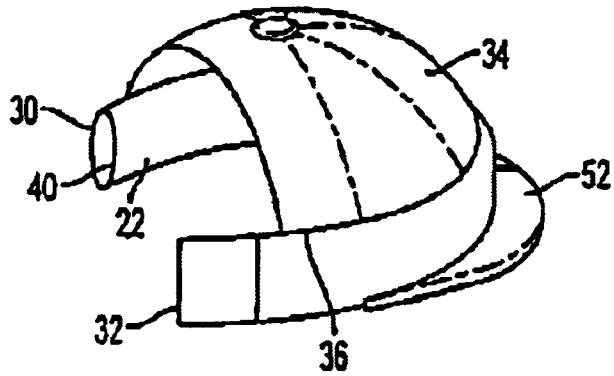
FIG. 2 is a perspective view illustrating some of the components of the head protection system illustrated in FIG. 1.

Referring initially to FIG. 1, there is shown a perspective view of a head protection system 20 incorporating features of the present invention which is appropriate for users of all ages but is especially appropriate for toddlers aged between about six months through about three years. Although the present invention will be described with reference to the embodiments shown in the drawings, it should be understood that the present invention can be embodied in many alternate forms or embodiments. In addition, any suitable size, shape or type of elements or materials could be used.

As illustrated in FIGS. 2–8 as well as in FIG. 1, the head protection system 20 includes an open-ended tubular cap band 22 of flexible material which may be composed of fabric or plastic, for example, for partially encircling the head of a wearer generally at the level of the forehead 26 of the wearer. A belt member 28 is slidably received through the tubular cap band 22, extending beyond open ends 30, 32 of the tubular cap band, and is adjustable lengthwise to accommodate the size of the head 24 of the wearer. A crown member 34 of a soft flexible material which may be composed of fabric or plastic-like material similar to that of the tubular cap band 22 is of a partial hemispherical shape having an equator region 36 which is attached to the tubular cap band 22 in any suitable manner depending upon the mutual materials of the components, as by sewing or heat sealing.

Figure 3:
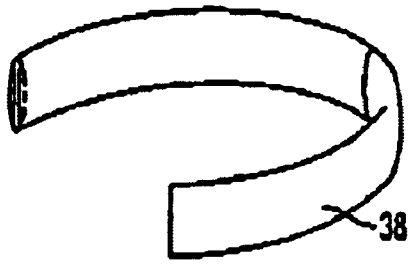
FIG. 3 is a perspective view of another component of the head protection system illustrated in FIG. 1.
Figure 4:
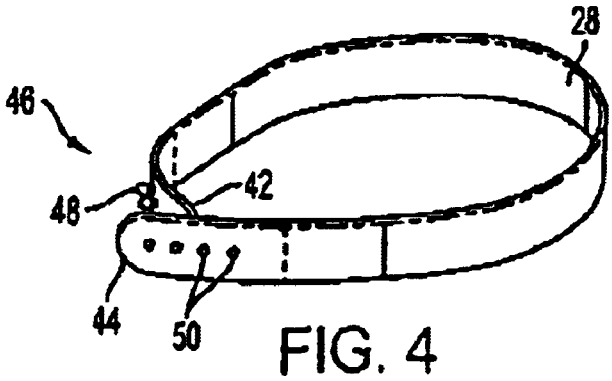
FIG. 4 is a perspective view of still another component of the head protection system illustrated in FIG. 1.
Figure 5:
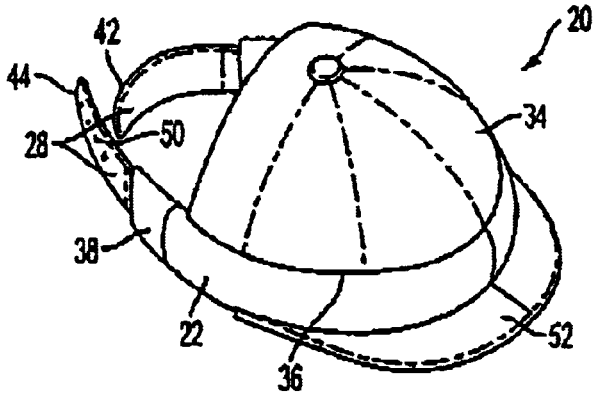
FIG. 5 is front quarter perspective view of an assembled head protection system.
Figure 6:
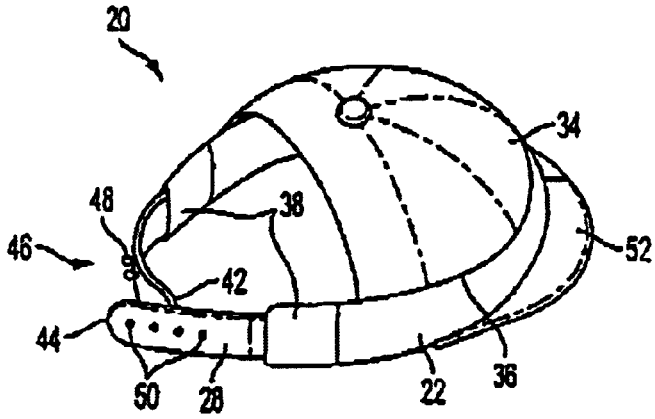
FIG. 6 is rear quarter perspective view of an assembled head protection system.
Figure 7:
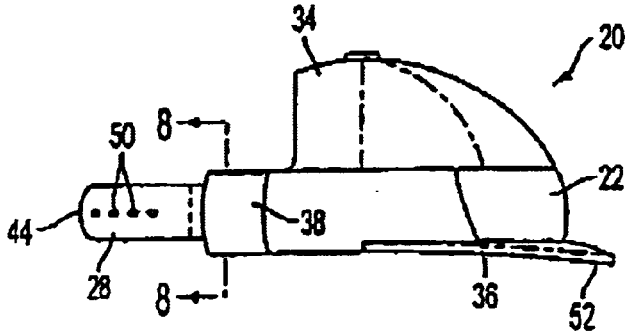
FIG. 7 is a side elevation view of the assembled head protection system illustrated in FIGS. 5 and 6.
Figure 8:
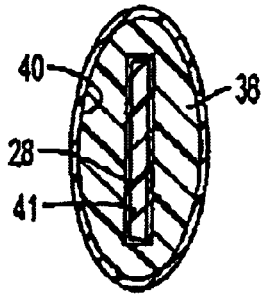
FIG. 8 is a cross section view taken generally along line 8-8 in FIG. 7.

As seen individually in FIG. 3 and in combination with the other components of the invention in FIGS. 2 and 4–8, a tubular cushion band 38 of resilient, preferably plastic or rubber-like material encompassing foam or gel material, is received through a lumen 40 (FIGS. 4 and 6) of the tubular cap band 22, and extends beyond the open ends 30, 32 of the tubular cap band. In turn, the cushion band 38 has its own passageway 41 (FIG. 8) for slidably receiving the belt member 28. The belt member 28 includes opposed ends 42, 44 extending beyond the open ends 30, 32 of the tubular cap band 22. Adjustable mutually engageable closure devices 46 are provided on the opposed ends 44, 46 of the belt member 28 for joinder to accommodate the size of the head 24 of the wearer of the head protection system 20.

As best seen in FIGS. 4–7, one form of the engageable closure devices 46 on the belt member 28 includes at least one pop bead closure member 48 (FIGS. 4 and 6), but preferably several at longitudinally spaced apart locations, on the first end 42 and at least two through holes 50, and preferably more, on a second end 44 for fittingly receiving the pop bead closure member, or others, to thereby join together the first and second ends.

Viewing FIGS. 2, 5, 6, and 7, a brim 52 which may be suitably reinforced, is attached to the tubular cap band 22 and positioned to overlie the face of the wearer of the head protection system 20.

Figure 9A:
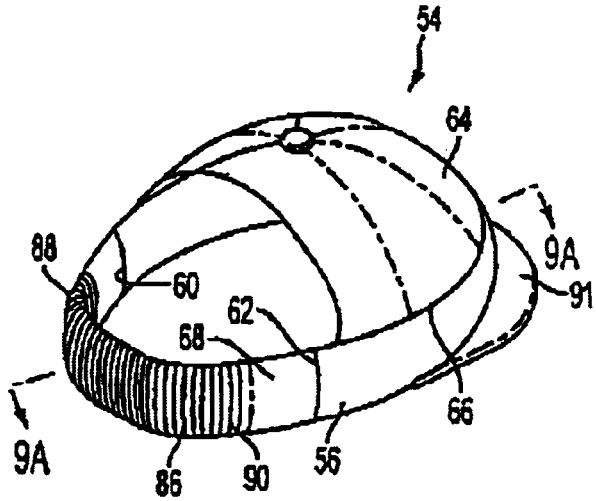
FIG. 9A is a cross section view taken generally along line 9A-9A in FIG. 9.
Figure 10:
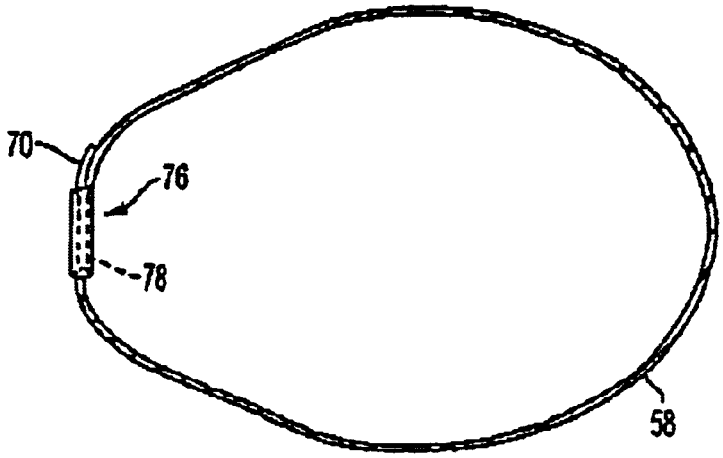
FIG. 10 is a top plan view of one component of the head protection system illustrated in FIG. 9.
Figure 9B:
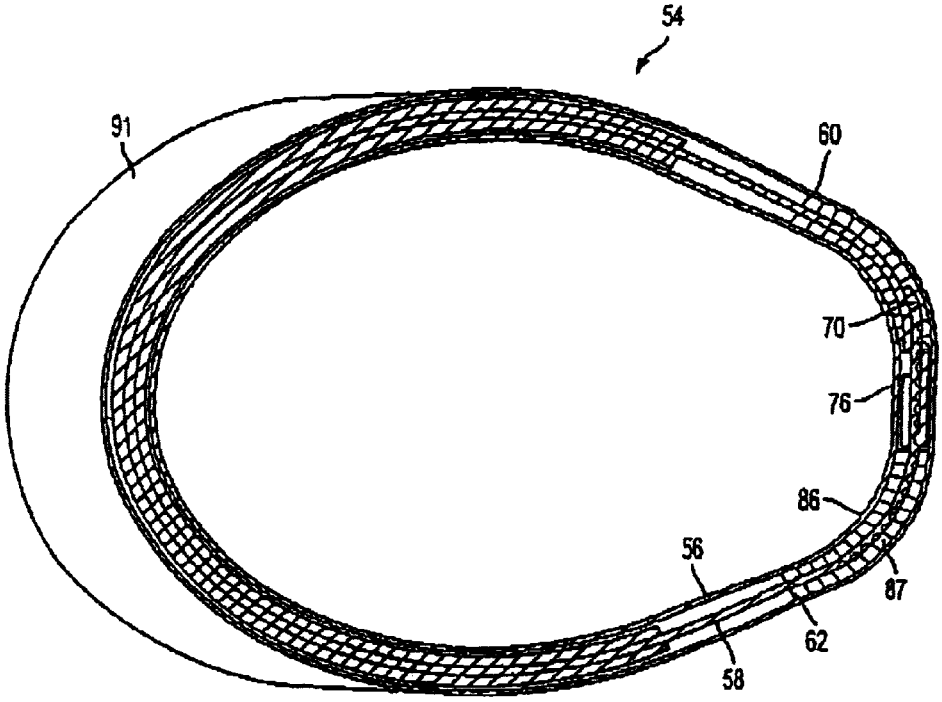
FIG. 9 is a rear quarter perspective view of another embodiment of an assembled head protection system.
Figure 11A:
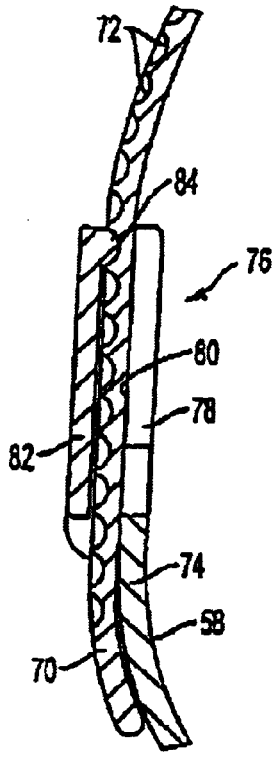
FIG. 11A is a detail cross section view taken generally along line 11A-11A in FIG. 11.
Figure 11B:
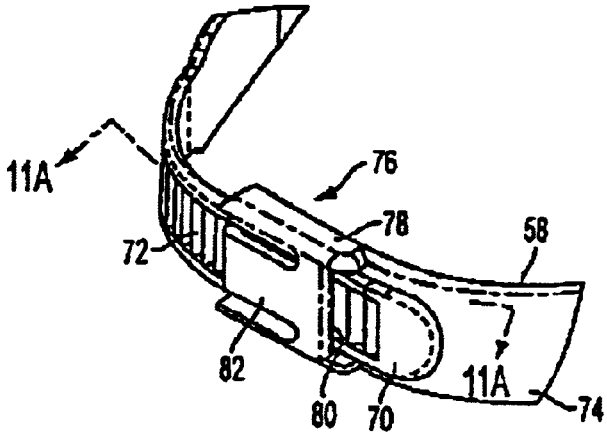
FIG. 11 is a detail perspective view of a portion of the head protection system illustrated in FIG. 9.

A modified head protection system 54 is seen in FIG. 9 and will be further described with the aid of FIGS. 9A, 10, 11, and 11A. As previously, the head protection system 54 includes an open-ended tubular cap band 56 of flexible material for partially encircling the head of a wearer generally at the level of the forehead of the wearer. A belt member 58 is alidably received through the tubular cap band extending beyond open ends 60, 62 of the tubular cap band 56 and is adjustable to accommodate the size of the head of the wearer. And, again, a crown member 64 of a partial hemispherical shape has an equator region 66 which is suitably attached to the tubular cap band 56. Finally, as before, a tubular cushion band 68 of resilient material is received through the tubular cap band 56 and extends beyond the open ends 60, 62 of the tubular cap band and, in turn, slidably receives the belt member 58.

In this instance, the belt member 58 includes a first end 70 formed with a plurality of similarly sized side-by-side semi-cylindrical indents 72 extending transversely of a longitudinal axis of the belt member. The belt member has a second end 74 including an integral spring member 76 in the form of a housing 78 with a channel 80 for slidably receiving the first end 70 of the belt member 58. A cantilever 82 integral with the housing 78 extends away from the housing to a semi-cylindrical lug member 84 at its extreme end. The lug member 84 extends transversely of the longitudinal axis of the belt member 58 and is biased into releasable engagement with a selected one of the semi-cylindrical indents 72 to thereby join together the first and second ends 70, 74 in a manner to snugly accommodate the head of the wearer of the head protection system 54.

A hollow bellows 86 of resilient material is longitudinally expansible and, with an internal channel 87 (FIG. 10), overlies the first and second ends 70, 74 of the belt member 58 as well as the spring member 76 and has opposite ends 88, 90 which reach, and are adjacent, to the open ends 60, 62 of the tubular cap band 56. The bellows 86 serves to protect the rear of the head of the wearer of the head protection system 54.

To complete the general construction of the head protection system 54, a brim 91 which may be suitably reinforced in the manner of the brim 52, is attached to the tubular cap band 56 and positioned to overlie the face of the wearer of the head protection system.

Figure 12A:
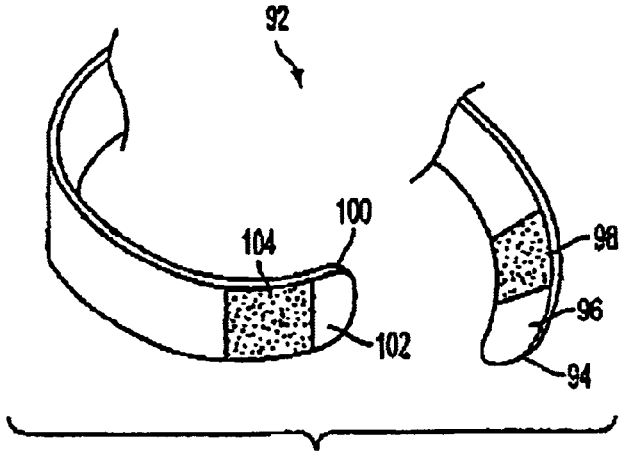
FIG. 12A is a top plan view of the portion of the portion of the embodiment of the head protection system illustrated in FIG. 12.
Figure 12B:
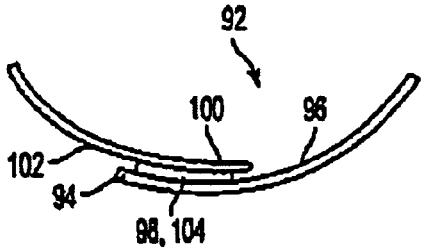
FIG. 12 is a detail perspective view of a portion of another embodiment of the head protection system.

In another instance of the closure device 46, viewing FIGS. 12 and 12A, a modified belt member 92 includes a first end 94 including a first surface 96 bearing one type 98 of hook and loop fastening material and a second end 100 including a second surface 102 facing the first surface and bearing an opposite type 104 of hook and loop fastening material to that on the first surface. With this construction, as the first and second surfaces 96, 102 are pressed together, the first and second ends 94, 100 are thereby joined together.

Turn now to FIGS. 13–17 for still another embodiment of the invention. In this instance, as previously, a modified head protection system 106 includes an open-ended tubular cap band 108 of flexible material for partially encircling the head of a wearer generally at the level of the forehead of the wearer. Again, a crown member 110 of a partial hemispherical shape has an equator region 112 which is attached to the tubular cap band 108. In contrast to the earlier described constructions, an elongated air bladder 114 of resilient rubber-like material is slidably received through the tubular cap band 108 such that it extends beyond open ends 116, 118 of the tubular cap band. An air pump 120 is mounted on a peak of the crown member distant from the equator region 112 and is connected to the interior of the air bladder 114 by means of a conduit 122 to selectively fill the air bladder 114 with air.

Figure 13:
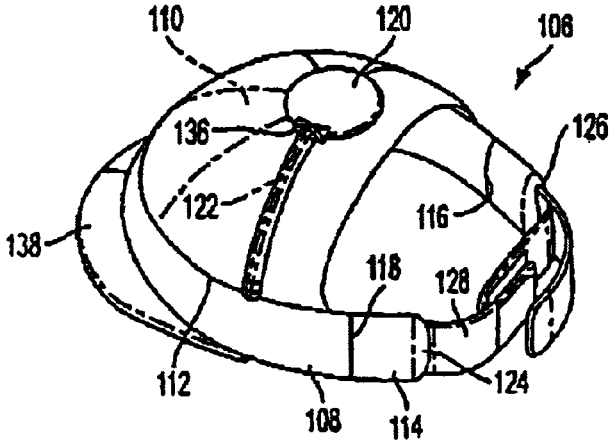
FIG. 13 is a rear quarter perspective view of still another embodiment of an assembled head protection system.
Figure 14:
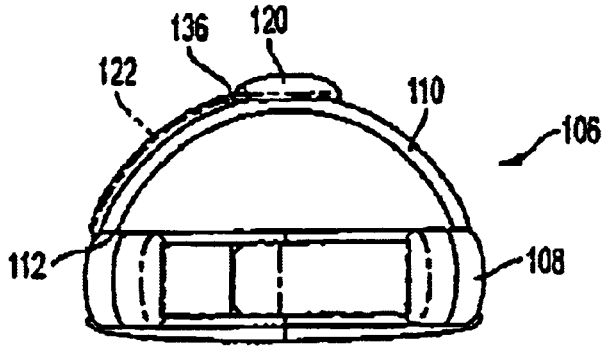
FIG. 14 is a rear elevation view of the embodiment illustrated in FIG. 13.
Figure 15:
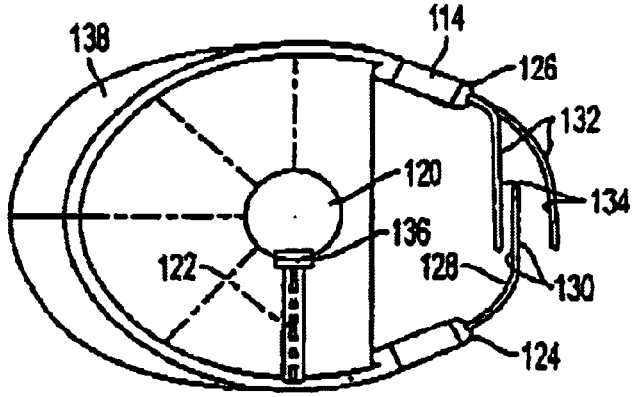
FIG. 15 is a top plan view of the embodiment illustrated in FIG. 13.
Figure 16:
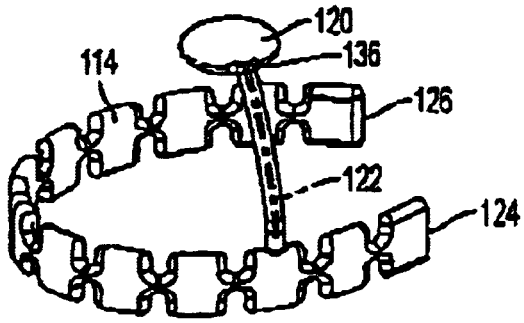
FIG. 16 is a perspective view of components which are part of the embodiment illustrated in FIGS. 13–15.
Figure 17:
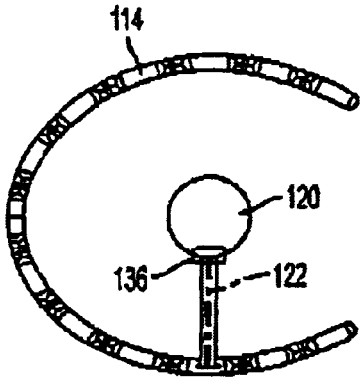
FIG. 17 is a top plan view of components which are part of the embodiment illustrated in FIGS. 13–15.

The air bladder 114 extends between first and second ends 124, 126, respectively, and, in one possible construction as illustrated in FIGS. 13 and 15, includes a first elongated tab member 128 integral with the first end 124 of the air bladder and having opposed surfaces 130 bearing one type of hook and loop fastening material. A pair of second elongated tab members 132 integral with the second end 126 of the air bladder have opposed second surfaces 134 facing, respectively, the opposed first surfaces 130. The second surfaces 134 bear an opposite type of hook and loop fastening material to that on the first surfaces 130 such that, as the first and second surfaces 130, 134, respectively, are pressed together, the first and second tab members 128, 132 are thereby joined together in a sandwich construction, the first elongated tab member 128 being intermediate the pair of second elongated tab members 132. A one-way valve 136 is diagrammatically illustrated as being associated with the air pump 120 to prevent the escape of air, once introduced, from the air bladder 114. To complete the general description of the head protection system 106, a brim 138 is attached to the tubular cap band 108 and is positioned to overlie the face of the wearer of the head protection system as in the earlier described embodiments.

Figure 18:
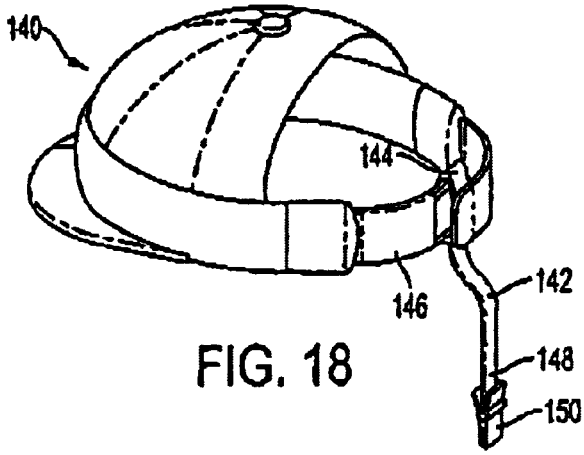
FIG. 18 is a rear quarter perspective view of yet another embodiment of the invention.

In FIG. 18, another head protection system 140 is illustrated which may be generally of the construction of any of the previously described embodiments. As such, a collar strap 142 is removably mounted at one end 144 on a belt member 146 and extends to a free end 148. A collar clip 150 is fixed on the free end 148 and is operable for releasable attachment to the clothing of the wearer of the head protection system for its retention in the event of its inadvertent removal from the head of the wearer.

Figure 19:
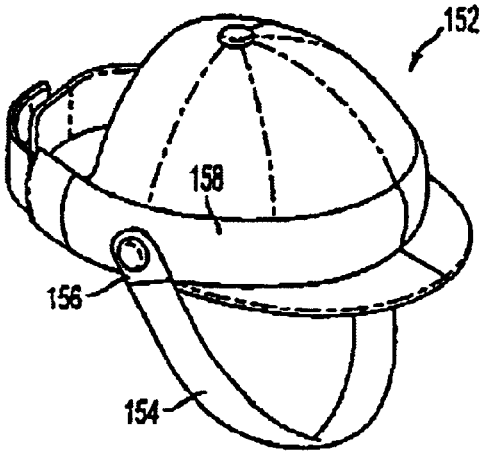
FIG. 19 is a front quarter perspective view of still a further embodiment of the invention.

In FIG. 19, still another head protection system 152 is illustrated which again may be generally of the construction of any of the previously described embodiments. As such, a chin strap 154 having opposite ends 156 pivotally attached to the cap band 158 at generally diametrically opposed locations for removable reception under the chin of the of the wearer of the head protection system 152.

Figure 20:
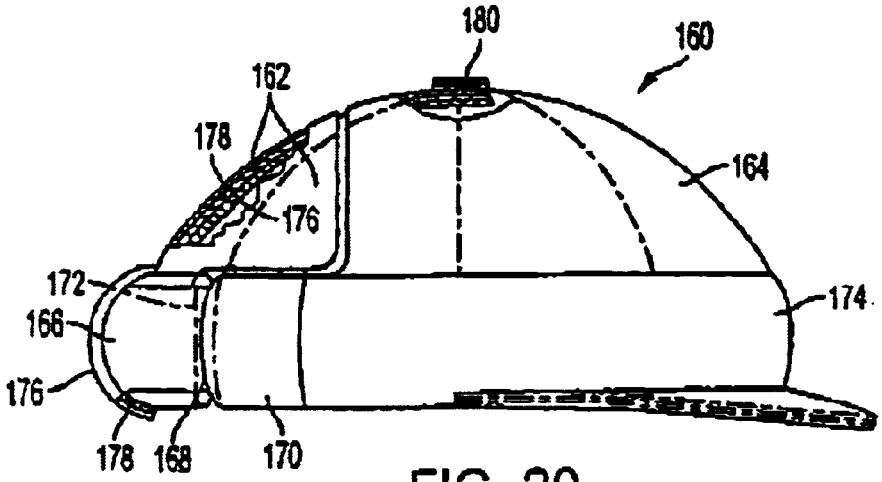
FIG. 20 is a side elevation view of yet a further embodiment of the invention.
Figure 21:
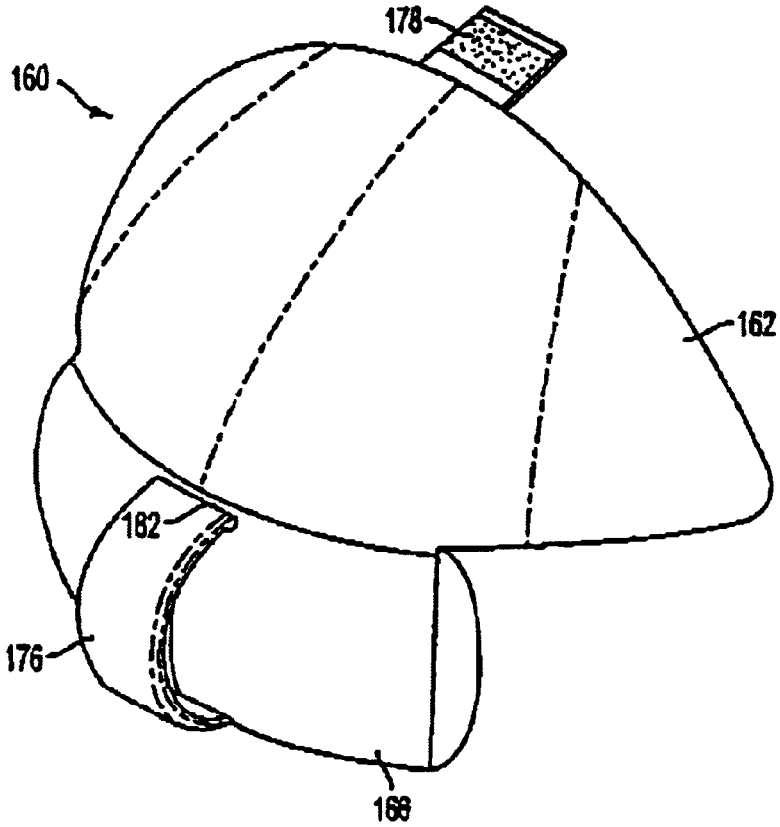
FIG. 21 is a rear quarter perspective view of certain components of the embodiment illustrated in FIG. 20.

Yet another head protection system 160 is illustrated in FIGS. 20 and 21 which, again may be generally of the construction of any of the previously described embodiments. In this instance, a rear cushion accessory includes a complementary crown member 162 formed to generally complete the hemispherical shape of the crown member 164. A cushion member 166 is attached to the ends 168 of the tubular cushion band 170 and is generally coextensive with the belt member 172 extending between the open ends of the tubular cap band 174. An attachment strap 176 extends between the cushion member and the crown member and, by means of hook and loop material 178 or other suitable fastening device, is releasably attachable to the cushion member 166 and to the crown member 164, preferably at a centrally located button 180, and indeed along the entire interior surface of the complementary crown member 162 for supporting the complementary crown member on the head protection system.

To enable this construction, the attachment strap 176 is received through a slit 182 in the cushion member so as to thereby pass into the interior of the system 140 and, specifically, adjacent an interior surface of the complementary crown member.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A head protection system comprising:

an open-ended tubular cap band of flexible material for partially encircling the head of a wearer generally at the level of the forehead of the wearer;

a belt member slidably received through the tubular cap band extending beyond the open ends of the tubular cap band and adjustable to accommodate the size of the head of the wearer;

a crown member of a partial hemispherical shape having an equator region which is attached to the tubular cap band; and a tubular cushion band of resilient material received through the tubular cap band, extending beyond the open ends of the tubular cap band and, in turn, slidably receiving the belt member.

2. A head protection system as set forth in claim 1 wherein the belt member includes opposed ends extending beyond the open ends of the tubular cap band; and including:

adjustable mutually engageable closure devices on the opposed ends of the belt member for joinder to accommodate the size of the head of the wearer of the head protection system.

3. A head protection system as set forth in claim 1 including:

a rear cushion accessory:

including:

a complementary crown member formed to complete the hemispherical shape of the crown member;

a cushion member attached to the complementary crown member and generally coextensive with the belt member extending between the open ends of the tubular cap band; and an attachment strap extending between the belt member and the crown member and releasably attachable thereto for supporting the complementary crown member and the cushion member on the head protection system.

4. A head protection system as set forth in claim 1 wherein the resilient material of the tubular cushion band is composed of at least one of foam or gel.

5. A head protection system as set forth in claim 2 wherein the belt member includes:

a first end including at least one pop bead closure member thereon; and a second end having at least two through holes for fittingly receiving the at least one pop bead closure member to thereby join together the first and second ends.

6. A head protection system as set forth in claim 1 including:

a brim attached to the tubular cap band and positioned to overlie the face of the wearer of the head protection system.

7. A head protection system as set forth in claim 2 wherein the belt member has a longitudinal axis and includes:

a first end having a plurality of similarly sized side-by-side semi-cylindrical indents extending transversely of the longitudinal axis of the belt member; and a second end including a spring member having a semi-cylindrical lug member extending transversely of the longitudinal axis of the belt member biased into releasable engagement with a selected one of the semi-cylindrical indents to thereby join together the first and second ends in a manner to snugly accommodate the head of the wearer of the head protection system.

8. A head protection system as set forth in claim 7 wherein the spring member includes:

a housing fixed on the second end of the belt member with a channel for slidably receiving therethrough the first end of the belt member; and a cantilever integral with the housing extending away therefrom to the lug member at its extreme end.

9. A head protection system as set forth in claim 7 including:

a bellows of resilient material overlying the first and second ends of the belt member and having opposite ends which reach, and are adjacent to, the open ends of the tubular cap band.

10. A head protection system as set forth in claim 2 wherein the belt member includes:

a first end including a first surface bearing one type of hook and loop fastening material; and a second end including a second surface facing the first surface bearing an opposite type of hook and loop fastening material to that on the first surface such that, as the first and second surfaces are pressed together, the first and second ends are thereby joined together.

11. A head protection system as set forth in claim 1 including:

a collar strap removably mounted at one end on the belt member and extending to a free end; and a collar clip fixed on the free end for releasable attachment to the clothing of the wearer of the head protection system for retention of the head protection system in the event of its inadvertent removal from the head of the wearer.

12. A head protection system as set forth in claim 1 including:

a chin strap having opposite ends pivotally attached to the cap band at diametrically opposed locations for removable reception under the chin of the of the wearer of the head protection system.

* * * * *